US006923884B2

(12) United States Patent
Eiban

(10) Patent No.: US 6,923,884 B2
(45) Date of Patent: Aug. 2, 2005

(54) PROCESS AND DEVICE FOR THE CUTTING OF LABEL SLEEVES

(75) Inventor: Günther Eiban, Regensburg (DE)

(73) Assignee: Krones AG, Neutraubling (DE)

( * ) Notice: Subject to any disclaimer, the term of this patent is extended or adjusted under 35 U.S.C. 154(b) by 87 days.

(21) Appl. No.: 10/339,046

(22) Filed: Jan. 9, 2003

(65) Prior Publication Data

US 2003/0145702 A1 Aug. 7, 2003

(30) Foreign Application Priority Data

Feb. 1, 2002 (DE) ..... 102 04 313

(51) Int. Cl.[7] ..... B65B 61/06

(52) U.S. Cl. ..... 156/264; 156/361; 156/521; 156/DIG. 8; 156/DIG. 9; 156/DIG. 12; 156/DIG. 14

(58) Field of Search ..... 53/399, 441, 442, 53/291, 556, 557, 292, 295, 296; 156/DIG. 36, DIG. 25, DIG. 12, DIG. 8, DIG. 14, 351, 361, 362, 363, 364, 256, 269, 270, 308.2, 309.9, 521, 264, DIG. 9; 83/54, 659, 459

(56) References Cited

U.S. PATENT DOCUMENTS

| | | | | |
|---|---|---|---|---|
| 2,579,458 A | | 12/1951 | Allen et al. | |
| 4,293,364 A | | 10/1981 | Fujio | |
| 4,497,156 A | * | 2/1985 | Scheidegger | 53/399 |

FOREIGN PATENT DOCUMENTS

| | | |
|---|---|---|
| DE | 2936989 | 4/1980 |
| EP | 0805110 B1 | 11/1997 |
| JP | 9077032 A1 | 3/1997 |
| WO | WO 00/66437 A1 | 11/2000 |

* cited by examiner

*Primary Examiner*—Linda Gray
(74) *Attorney, Agent, or Firm*—Marshall, Gerstein & Borun LLP

(57) ABSTRACT

A process and a device for cutting label sleeves off from a flat tubular belt, unfolding and attaching the tubular label sleeves to objects, whereby a flat label sleeve is, no later than immediately after the cutting off of the tubular label belt, grasped on one side, transported continuously away, in a regular manner, by a cutting device while likewise grasped on the opposite side for a short time, in a non-uniform manner relative to the other side, transported in the same direction, and is, after that, opened by means of a lateral expansion of distance of both of the flat sides.

18 Claims, 2 Drawing Sheets

PROCESS AND DEVICE FOR THE CUTTING OF LABEL SLEEVES

FIELD OF THE INVENTION

The invention relates to a process and device for cutting label sleeves off from a flat tubular label belt, and unfolding and attaching the tubular label sleeves to objects.

Corresponding processes and devices are known from the European patent EP 0 805 110 B1 and the Japanese patent disclosure document JP-A-9-77032.

Upon cutting label sleeves off of a flat tubular label belt, the problem arises that the edges of a cut-off label sleeve positioned one above the other and proceeding forward in the direction of transport can frequently only be opened with difficulty. In order to facilitate the opening of the cut label sleeves, it is proposed, in EP 0 805 110 B1, to twist the lateral edges of the label sleeves by means of stationary turning plates projecting into the path of transport in such a manner that the cut edges on the leading end that are still clinging to one another after the cutting do detach.

In JP-A-9-77032, the problem is supposed to be eliminated through the fact that the cut label sleeves are conveyed, on a non-linear, approximately S-shaped transport path, to an unfolding device, whereby the non-linear transport path is supposed to detach the cut edges of the label sleeves that are adhering to one another.

SUMMARY OF THE INVENTION

The task which forms the basis for this invention is that of presenting a process and a device that should make an effective and operationally-secure detaching of the leading edge of label sleeves possible before the unfolding.

By means of the short-term, continuously irregular movement of the one side of the still-flat label sleeves relative to the other side, which is moved in a regular manner, the cut edges adhering to one another can, under certain circumstances, be detached from one another, as the result of which the opening and complete unfolding into a tubular label sleeve is, in an advantageous manner, facilitated considerably.

On the device side, this is brought about by means of a continuously-drivable conveyor belt acting on one side of the flat label sleeve and a second conveyor, continuously drivable in a periodically irregular manner and acting on the other side, which second conveyor can be configured as a simple friction roller or belt, for example. A configuration in which a label sleeve is grasped, during the phase of the non-uniform transport movement, over approximately its entire length in a force-locking or frictionally-engaged manner, as the case may be, is particularly advantageous. A belt dimensioned to be correspondingly long can be provided for this purpose. It is, however, also conceivable to position several friction rollers one above the other.

If the device is, for the production of the periodically irregular movement, provided with its own electromechanical servo drive, then the amplitude, duration of period, phase position, and average conveyor speed can be very comfortably adjusted to different characteristics of the label (length, diameter, material, etc.) in connection with a programmable control, and the corresponding parameters can, in the event of a reconfiguration, be recalled from a memory store.

BRIEF DESCRIPTION OF THE DRAWINGS

Further advantageous configurations are the object of the remaining sub-claims. One preferred example of implementation will be illustrated in the following by means of the figures. These depict:

DETAILED DESCRIPTION OF THE INVENTION

Figure 1:
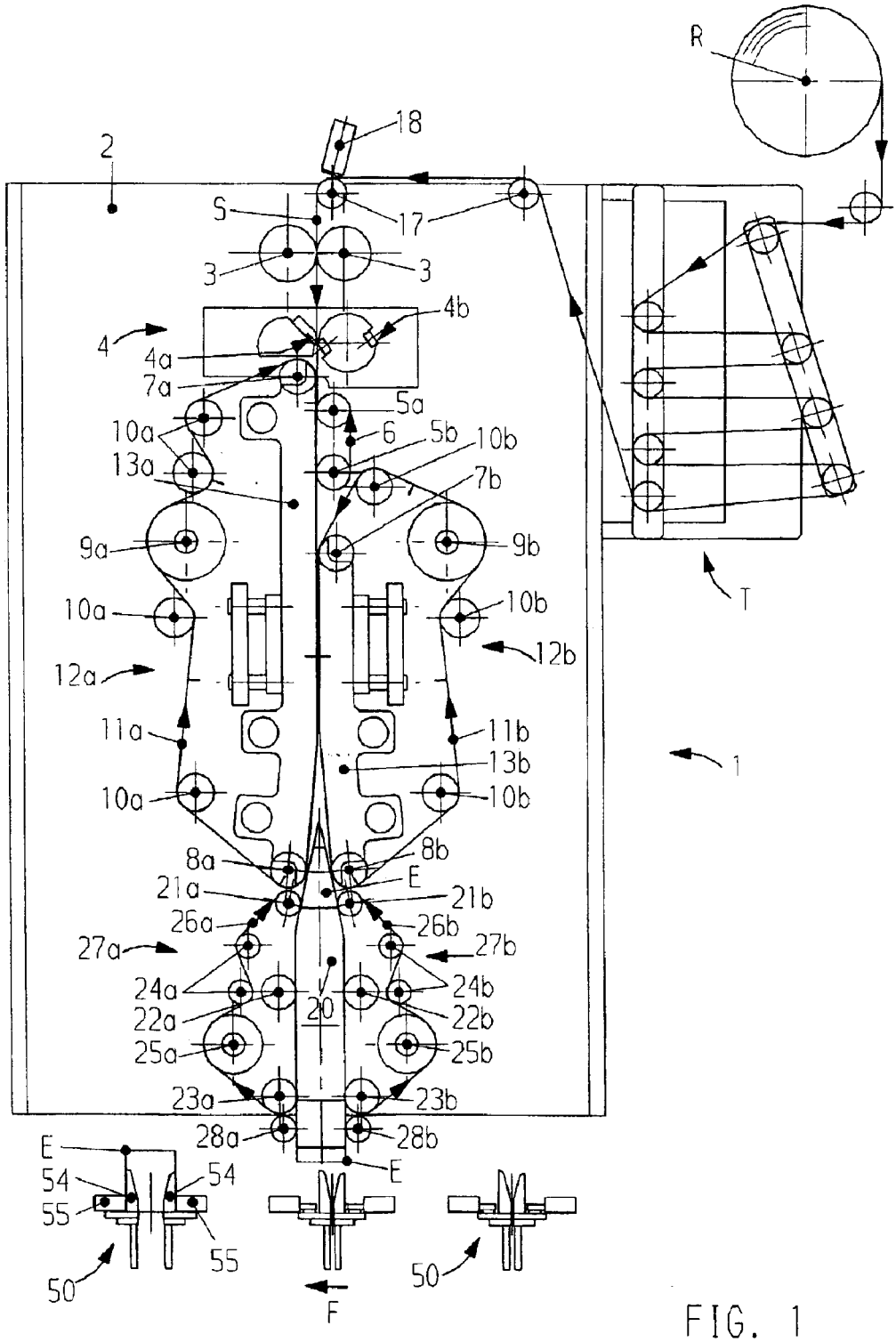
FIG. 1: A frontal view of an assembly for cutting label sleeves off from a flat label sleeve and unfolding the label sleeves.

The device (1) has a vertically-oriented mounting plate (2), to the side of which a compensation roller unit (T) is positioned. On the front side of the mounting plate (2)—and considered in sequence from top to bottom—there are provided two deflecting rollers (17), a pair of forward feed rollers (3), a cutting mechanism (4)—consisting of a stationary blade (4*a*) and a cutting roller (4*b*) drivable in a rotating manner—, two conveyor belts (12*a* and 12*b*) underneath that, which are positioned opposite one another and operating together in the same direction, with the lower end area of which an unfolding mandrel (20), likewise with two conveyor belts (27*a* and 27*b*) placed opposite to its sides, is connected. Below these conveyor belts (27*a* and 27*b*), two acceleration rollers (28*a* and 28*b*) are located at the lower end of the unfolding mandrel (20).

The entire device (1) is positioned, in a height-adjustable manner, slightly above the horizontal circumferential plane of expanding wedge units (50) rotating on a closed track in the direction (F) of a machine for the placing of label sleeves (E) onto objects, such as bottles or the like. A corresponding machine is disclosed in detail in the international patent application WO 00/66437. An expanding wedge unit (50) has two arched half-shells (54), each oriented vertically upward, the curvature of which is adjusted to the external shape of the object to be labeled, such as a beverage bottle, for example. A pressure body (55) which can be moved forward and radially controlled from the outside, such as an elastic rubber buffer, for example, is coordinated with each half-shell (54). The construction and the function of this expanding wedge (50) is described in detail in the above-noted WO 00/66437.

The conveyor belt (12*a*) is essentially formed from a vertically-positioned vacuum casing (13*a*) and an endless flat belt (11*a*), which is vertically guided on the same in a sliding manner. The movement track of the perforated flat belt (11*a*) is determined by several deflecting- and tension rollers (10*a*), a drive wheel (9*a*), and two deflecting rollers (7*a* and 8*a*) attached to the vacuum casing (13*a*), whereby the upper deflecting roller (7*a*) is located immediately below the stationary blade (4*a*), while the lower deflecting roller (8*a*) reaches as far as the unfolding mandrel (20). The conveyor belt (12*b*) positioned diametrically opposite the conveyor belt (12*a*) likewise has a vertically-positioned vacuum casing (13*b*) and a flat belt (11*b*) guided thereon revolving vertically in a drivable manner, the circumferential track of which is determined by deflecting- and tension rollers (10*b*), and a driving roller (9*b*) and an upper deflecting roller (7*b*) supported rotatably on the vacuum casing (13*b*), as well as a lower deflecting roller (8*b*) in the area of the unfolding mandrel (20). In a manner different from the conveyor belt (12*a*), the conveyor belt (12*b*) is, however, configured in a shortened form, that is to say, the upper deflecting roller (7*b*) is located at some distance below the rotating cutting roller (4*b*), that is to say, positioned lower than the upper deflecting roller (7*a*) of the conveyor belt (12*a*), while the lower deflecting rollers (8*a* and 8*b*) are positioned at approximately the same height at a distance from one another. The vertical displacement between the two upper deflecting rollers (7*a* and 7*b*) amounts to a multiple of the length of the individual label sleeves (E).

A drivable friction element which, in the present example of implementation, is configured in the form of a friction belt (6) guided by means of a deflecting roller (5*a*) and a driving roller (5*b*), the strand of which friction belt, oriented towards the flat belt (11*a*), is placed proceeding in parallel to this, is positioned in the free space between the rotating cutting roller (4*b*) and the upper deflecting roller (7*b*) of the conveyor belt (12*b*). This friction belt (6) preferably has a longitudinal extension corresponding approximately to the length of the individual label sleeve (axial distance [5*a* and 5*b*]). As can be inferred from FIG. 1, the two lower deflecting rollers (8*a* and 8*b*) of the conveyor belts (12*a*, 12*b*) have a mutual horizontal distance, and the lower end areas of the vacuum casing (13*a*, 13*b*) have a gradient of contour expanding laterally outwardly from the direction of transport of the label sleeve (E) and proceeding vertically downwardly, which gradient yields, in the direction towards the unfolding mandrel (20), a wedge space opening with a V-shape between the flat belts (11*a* and 11*b*), into which space the upper, wedge-shaped pointed end of the otherwise cylindrical unfolding mandrel (20) extends.

The two vacuum casings (13*a*, 13*b*) are each supported in an adjustable manner on horizontal guide units, so that their distance from each other, and thereby that of the flat belts (11*a* and 11*b*) as well, can be continuously adjusted in order to adapt to the characteristics (materials strength, etc.) of the label sleeves. The tension of the flat belt (11*a* or 11*b*, respectively) can thereby be adjusted by at least one of the deflecting rollers (10*a* or 10*b*, respectively).

The vertically-oriented unfolding mandrel (20) is held, in the known manner, by two tension rollers (22*a* and 22*b*) which are supported in a freely rotatable manner. Support rollers, which are not further discussed and which cooperate with the tension rollers, which support rollers determine the height position of the unfolding mandrel (20) but at the same time make possible the moving of label sleeves (E) by means of the conveyor belts (27*a* and 27*b*) acting on the opposite sides, however, are located in the unfolding mandrel (20). The conveyor belt (27*a*) has a flat belt (26*a*), which is guided vertically by means of an upper deflecting roller (21*a*) positioned immediately below the deflecting roller (8*a*), a lower deflecting roller (23*a*), a driving roller (25*a*), and deflecting- and tension rollers (24*a*) on a closed track. In precisely the same manner, the flat belt (26*b*) of the conveyor belt (27*b*) is guided in a symmetrical arrangement.

The lower end of the unfolding mandrel (20) projects vertically downwardly over the lower deflecting rollers (23*a* and 23*b*), whereby two acceleration rollers (28*a* and 28*b*) are positioned in this area immediately below the deflecting rollers (23*a* and 23*b*).

The forward feed rollers (3), the cutting mechanism (4), the conveyor belts (12*a* and 12*b*), the conveyor belts (27*a* and 27*b*), as well as the acceleration rollers (28) have their own electromechanical servo drives, not depicted in further detail in FIG. 1, which, by means of a common control unit (14) (FIG. 3), permit an operating sequence of the stated devices in a manner synchronous in speed and position.

Figure 3:
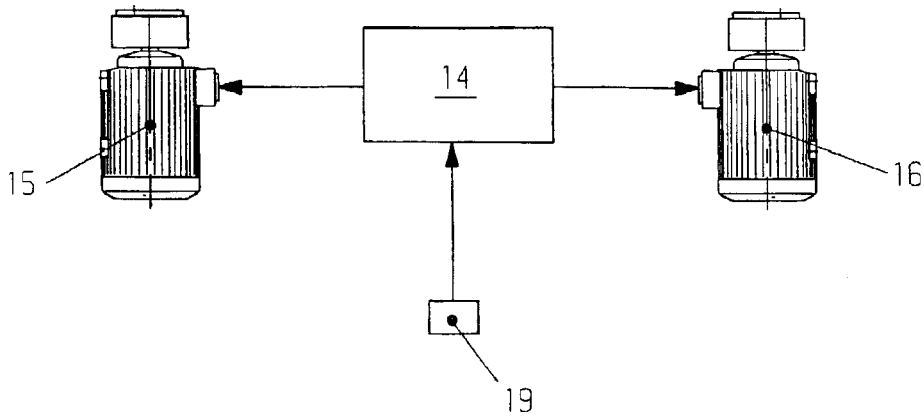
FIG. 3: A schematic depiction of the control and drive of the conveyor.

In accordance with FIG. 3, the control (14) is connected with a rotation-imparting unit (19) positioned in the actual labeling machine, by means of which the control unit can control the servo drive (15) for the conveyor belts (12*a*, 12*b*, as well as 27*a*, 27*b*, if necessary) and the servo drive (16) for the friction belts (6) to be periodically driven in a non-uniform manner, precisely accurate in position in regard to the movement of the expanding wedge units (50) of the labeling machine serving as a control variable.

The function of the device (1) will be illustrated in the following:

A flat tubular belt (S) is removed from a label tube roller (R), transported, by means of a compensation roller (T) and deflecting roller (17), to the gap of the forward feed rollers (3) contacting each other, whereby the tubular belt passes a sensor (18) recognizing the printed pattern or invisible markings. The signals of the sensor make possible for the electrical servo drive of the forward feed rollers (3) a positionally-accurate transporting of the tubular label belt (S) to the cutting mechanism (4) in a manner corresponding to the printed pattern.

The tubular belt (S) introduced between the stationary blade (4*a*) and the rotating cutting roller (4*b*) moves, before the separation of a label sleeve (E) on one of its two flat sides, into placement with the vacuum-activated flat belt (11*a*) of the conveyor belt (12*a*). During this phase, there is some slippage on the flat belt (11*a*), which is driven faster in relation to the tubular belt, as the result of which the tubular belt (S) is, in an advantageous manner, continuously drawn tightly until the separation of a label sleeve (E). Immediately after the separating of the tubular belt (S), the cut-off label sleeve (E), which is still flat, can now follow the speed of the flat belt (11*a*), so that the label sleeve (E) is accelerated vertically downwardly, and is thereby brought onto the calibration dimension of the labeling machine. This calibration dimension can amount to a multiple of the length of the label sleeve (E).

Figure 2:
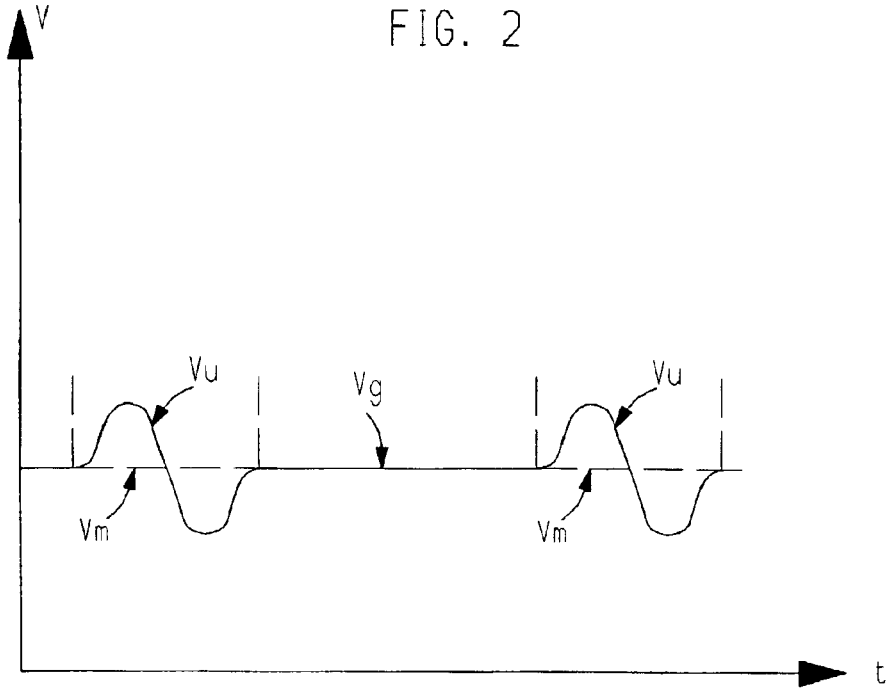
FIG. 2: The speed gradient of the conveyor transporting the cut label sleeves from a cutting device to an unfolding device.

As soon as a label sleeve (E) is located in the area between the flat belt (11*a*) and the friction belt (6), which acts on the opposite flat side of the label sleeve (E) in a frictionally-engaged manner, the electrical servo drive (16) of the friction belt (6) is driven by the time control, which has up to that time been synchronous in speed with the servo drive (15) of the flat belt (11*a*), in a diverging, short-term irregular manner, corresponding to the representation in FIG. 2, temporarily with increased and then with reduced speed (or vice versa) relative to the flat belt (11*a*), whereby a relative movement is carried out lengthwise to the vertical direction of transport of the label sleeve (E) between the two flat sides, with the result that the cut edges of the label sleeve (E) proceeding forward into the direction of transport are detached from one another, before the label sleeve (E) proceeds into the gap between the two flat belts (11*a* and 11*b*). The average speed (Vm) of the periodically non-uniform movement (Vu) corresponds to the continuously uniform speed (Vg) of the flat belt (11*a*), so that both of the cut edges of the label sleeve (E), which are positioned one on top of another after leaving the friction belt (6), are again located in a position parallel to one another. The sequence of movement depicted is periodically repeated with each newly cut-off label sleeve (E).

During the further process, the two flat sides of a cut label sleeve (E) are, upon the passage of the parallel-proceeding sections of the two vacuum casings (13*a* and 13*b*) through the perforation apertures present in the flat belts, suctioned onto the flat belts (11*a* and 11*b*). During the subsequent backwards movement of the label sleeve, this is continuously opened by the lower area, of the vacuum casings (13*a* and 13*b*) positioned opposite, which expand laterally in a V-shape, so that the tip of the unfolding mandrel (20) can penetrate into the aperture of the label sleeve (E) that arises. The label sleeve is, by means of the lower deflecting rollers (8*a* and 8*b*), pressed against the roof-shaped surfaces in the upper section of the unfolding mandrel (20) and displaced further vertically in the longitudinal direction until the label sleeve is, in the area of the upper deflecting rollers (21*a* or 21*b*, respectively), grasped by the next-following conveyor belt (27*a* and 27*b*) and thereby taken over.

These conveyor belts (27*a* and 27*b*), which are driven synchronously with the conveyor belts (12*a* and 12*b*) located above that, grasp the label sleeves in a frictionally-engaged manner and continuously displace them further backwards vertically through the unfolding mandrel (20), making a transition into a cylindrical shape in the area of the acceleration rollers (28*a* and 28*b*) positioned thereunder, which are, first of all, driven in a manner synchronous in speed with the flat belts (26*a* and 26*b*) for long enough until the next-following edge of the label sleeve is out of contact with the conveyor belts (27*a* and 27*b*). After that, the label sleeve (E), which is folded in a tubular manner, is accelerated vertically downwardly by the electromechanical servo drive of the acceleration rollers in order to slide the completely opened label sleeve (E), on an opened expanding wedge unit (50) horizontally proceeding, at the same moment, under the stationary unfolding mandrel (20), within the shortest time and in a precisely positioned manner. From the cutting until the complete unfolding of a label sleeve (E), this is moved on a continuous straight track.

What is claimed is:

1. A process for cutting label sleeves off from a flat tubular label belt, and unfolding and attaching the tubular label sleeves to objects, comprising: cutting off the tubular belt so as to expose two sides of a flat label sleeve, no later than immediately after the cutting off of the tubular label belt, grasping the flat label sleeve on one side thereof; transporting the flat label sleeve continuously away, in a regular manner, from the cutting device; likewise grasping the flat label sleeve on the opposite side for a short time, in a non-uniform manner relative to the other side; transporting the flat label sleeve in the same direction; and thereafter, unfolding the flat label sleeve by laterally expanding a distance between the two flat sides.

2. A process in accordance with claim 1, and, after the cutting off of the tubular label belt and up to the complete unfolding, transporting the label sleeve on a linear track.

3. A process in accordance with claim 2, wherein the linear track is generally vertical.

4. A process in accordance with claim 1, and wherein the opposite side of the label sleeve is first of all accelerated relative to the one side and subsequently decelerated relative to the one side.

5. A process in accordance with one of the claim 1, wherein both sides of a flat label sleeve have a leading cut edge which, immediately after the cutting, proceed in parallel, during the continuous non-uniform movement of the one side of the label sleeve in the direction of transport in a reciprocally offset manner, and are, before the unfolding, oriented in parallel again.

6. A process in accordance with claim 5, wherein the offset of the cut edges during the continuous non-uniform movement is changeable.

7. A process in accordance with claim 6, wherein the changeable offset is in dependence on one of the diameter, length, and combination thereof of the label sleeve.

8. A process in accordance with claim 1, and wherein the opposite side of the label sleeve is first of all decelerated relative to the one side and subsequently accelerated relative to the one side.

9. A process for the cutting off of label sleeves (E) from a flat tubular label belt (S), and unfolding and application of the tubular label sleeves onto objects, comprising: first of all grasping a flat label sleeve (E), in the area after a cutting mechanism (4), by a conveyor belt (12*a*) on one side; continuously transporting the flat label sleeve away, in a uniform manner, from the cutting mechanism (4); and during the above transporting step, the opposite side of the flat label sleeve is grasped in a non-uniform manner relative to the one side by an additional conveyor (6), which is driven periodically in a non-uniform manner, to transport the flat label sleeve in the same direction; and thereafter, opening the flat label sleeve by increasing a lateral spacing of the conveyor belt (12*a*) from the additional conveyor (6).

10. A device for cutting off label sleeves (E) from a flat tubular label belt (S), and for unfolding and applying the tubular label sleeves onto objects, comprising: a cutting mechanism (4) for cutting off a flat label sleeve; a conveyor belt (12*a*) adapted to grasp one side of a cut off label sleeve and continuously transport the cut off label sleeve away in a uniform manner; and an additional conveyor (6) driven in a non-uniform manner adapted to grasp the opposite side of the cut off label sleeve in a non-uniform manner relative to the one side and to transport the cut off label sleeve in the same direction.

11. A device in accordance with claim 10, wherein the one conveyor belt (12*a*) extends as far as directly up to the cutting mechanism (4) and the additional conveyor (6), with the additional conveyor (6) being periodically driven in a non-uniform manner and positioned opposite to the conveyor belt (12*a*).

12. A device in accordance with claim 11, and wherein the additional conveyor (6) is positioned opposite the conveyor belt (12*a*) at a distance from the cutting mechanism (4).

13. A device in accordance with claim 10, wherein the conveyor belt (12*a*) is configured as a vacuum conveyor, and the conveyor (6) is configured as a friction conveyor.

14. A device in accordance with claim 10, wherein the conveyor (6) has a length approximately corresponding to the length of one label sleeve (E).

15. A device in accordance with claim 10, wherein the conveyor (6) is configured as a belt oriented approximately gap-free in parallel with the conveyor belt (12*a*).

16. A device in accordance with claim 10, and a second conveyor belt (12*b*) is connected to the downstream end of the conveyor (6), said second conveyor belt (12*b*) extending parallel to the first conveyor belt (12*a*) for some distance along the conveying direction, and then diverging away from the first conveyor belt (12*a*).

17. A device in accordance with claim 10, wherein the conveyor (6) can be continuously driven to a labeling machine, by means of an electromechanical servo drive (16) with a coordinated program control (14), in a periodically non-uniform manner.

18. A device in accordance with claim 17, and wherein the conveyor (6) is continuously driven in a periodically non-uniform manner synchronously in speed and position.

* * * * *